US008763276B2

(12) United States Patent
Greene et al.

(10) Patent No.: US 8,763,276 B2
(45) Date of Patent: Jul. 1, 2014

(54) REMOVABLE OUTSOLE ELEMENTS FOR ARTICLES OF FOOTWEAR

(75) Inventors: Pamela S. Greene, Portland, OR (US); James E. Goddard, Portland, OR (US); Christopher C. Wu, Granada Hills, CA (US)

(73) Assignee: NIKE, Inc., Beaverton, OR (US)

( * ) Notice: Subject to any disclaimer, the term of this patent is extended or adjusted under 35 U.S.C. 154(b) by 716 days.

(21) Appl. No.: 13/037,567

(22) Filed: Mar. 1, 2011

(65) Prior Publication Data

US 2012/0222332 A1 Sep. 6, 2012

(51) Int. Cl.
*A43C 13/00* (2006.01)

(52) U.S. Cl.
CPC ..... *A43C 13/00* (2013.01)
USPC ..... 36/15; 36/59 R; 36/67 D

(58) Field of Classification Search
CPC ..... A43C 13/00; A43C 13/04; A43C 15/00; A43C 15/16; A43C 15/161; A43C 15/162; A43C 15/168; A43B 3/24; A43B 3/246
USPC ..... 36/67 R, 67 D, 15, 134, 59 R, 59 C
See application file for complete search history.

(56) References Cited

U.S. PATENT DOCUMENTS 3,054,197 A * 9/1962 Morgan et al. ..... 36/59 R
3,331,148 A * 7/1967 Hollister et al. ..... 36/67 A
3,566,489 A * 3/1971 Morley ..... 36/67 D
4,351,120 A * 9/1982 Dalebout ..... 36/117.3
4,377,042 A * 3/1983 Bauer ..... 36/101
4,414,763 A * 11/1983 Bente ..... 36/134
4,492,047 A * 1/1985 Arff ..... 36/134
4,570,363 A * 2/1986 Annovi ..... 36/117.4
4,633,600 A * 1/1987 Dassler et al. ..... 36/134
4,644,672 A * 2/1987 Dassler et al. ..... 36/134
5,661,915 A * 9/1997 Smith ..... 36/15
5,743,029 A * 4/1998 Walker et al. ..... 36/134
5,875,572 A * 3/1999 Redburn ..... 36/134
7,249,428 B1 * 7/2007 Burella ..... 36/134
8,206,630 B2 * 6/2012 Sussmann et al. ..... 264/250
2002/0133978 A1 * 9/2002 Liao ..... 36/67 D

OTHER PUBLICATIONS

Castration Ring Pliers, Amazon.com: Castration Ring Pliers: Pet Supplies; http://www.amazon.com/Durvet-Catration-Ring-Pliers/dp/B000HHQGEU, 5 pages, accessed on Oct. 19, 2011.
Nike Mowabb II Considered 311852 271 Dk Cinder DK Cinder DK Oak Black; Nike Mowabb II Considered 311852 271 dk cinder dk oak black sale online,discounts—www.nikeairzoomkyotee.info, http://www.nikeairzoomkyotee,info/Nike-ACG-Boots/Nike-Mowabb-II-Considered-311852-271-dk-cinder-dk-cinder-dk-oak-bl . . . ; 3 pages, accessed on Jul. 24, 2012.

* cited by examiner

*Primary Examiner* — Marie Bays
(74) *Attorney, Agent, or Firm* — Plumsea Law Group, LLC

(57) ABSTRACT

An outsole element for an article of footwear having a base and a lug that extends from the base. The outsole element includes a body and a cavity defined in the body. The cavity receives the lug to removably couple the body to the lug. Also, the cavity includes an internal undercut.

24 Claims, 5 Drawing Sheets

REMOVABLE OUTSOLE ELEMENTS FOR ARTICLES OF FOOTWEAR

FIELD

The present disclosure relates to articles of footwear and, more particularly, relates to removable outsole elements for articles of footwear.

BACKGROUND

This section provides background information related to the present disclosure which is not necessarily prior art.

Articles of footwear usually include an upper, a midsole, and an outsole. The outsole is typically a unitary piece of relatively high-friction material that includes various projections, grooves, undercuts, and other features. Also, the outsole is most often permanently fixed to the midsole.

Although conventional outsoles for articles of footwear have been adequate for the intended purposes, they do suffer from certain disadvantages. For instance, outsoles are often permanently bonded to the midsole using primers, adhesives, and other chemicals that can be environmentally harmful.

Also, the wearer has less ability to customize the article of footwear because of the fixed outsole. More specifically, the wearer might need the footwear to provide a certain degree of traction depending on the terrain, weather, or other condition. However, because the outsole is permanently fixed, the wearer would likely have to change the entire article of footwear to satisfy these needs.

Additionally, the footwear's aesthetics cannot be easily changed due to the permanently fixed outsole. For instance, the wearer may grow tired of the footwear over time and desire to change the color or pattern of the outsole. However, because of the fixed outsole, the wearer has less ability to make these changes.

In addition, the outsole can wear quickly in comparison to the other portions of the article of footwear. Specifically, localized areas of wear and/or holes can develop which can degrade the ability of the outsole to provide adequate traction. Thus, the usable life of the shoe can be limited by the durability of the outsole.

Moreover, components of footwear can be recycled for various uses. Outsoles, for instance, can be reduced and used to form resilient ground surfaces on playgrounds, running tracks and the like. However, because the outsoles are fixed to the midsole, recycling efforts can be energy intensive.

Furthermore, the marketability of the footwear can be limited by the fixed outsole. For instance, certain outsoles may only be useful to a relatively small number of customers, and because of the fixed outsole, the footwear may be less profitable.

SUMMARY

Accordingly, despite the known footwear described above, there remains a need for an article of footwear that has a variable outsole. In addition to other benefits that will become apparent in the following disclosure, the device of the present disclosure fulfils these needs.

An outsole element is disclosed for an article of footwear having a base and a lug that extends from the base. The outsole element includes a body and a cavity defined in the body. The cavity receives the lug to removably couple the body to the lug. Also, the cavity includes an internal undercut.

In another aspect, an article of footwear having a base is disclosed. The article of footwear includes a lug that extends from the base. The article of footwear also includes an outsole element having a body and a cavity defined in the body. The cavity receives the lug to removably couple the body to the lug. Also, the cavity includes an internal undercut.

In an additional aspect, a system for modifying an article of footwear having a midsole with a base and a lug that extends from the base is disclosed. The system includes a plurality of outsole elements, each having a body and a cavity defined in the body. The cavity receives the lug to removably couple the body to the lug. The cavity includes an internal undercut, and at least one of the plurality of outsole elements is resiliently flexible. Also, the system includes a tool and method for selectively resiliently flexing the outsole element to removably couple the outsole element to the lug.

In still another aspect, an article of footwear is disclosed. The article of footwear includes a midsole that includes a base and a plurality of lugs disposed in spaced relationship relative to each other. The lugs extend from the base, and each includes a terminal end with a flange and an undercut disposed between the respective flange and the base. The article of footwear also includes a plurality of separate continuous, ring-shaped outsole elements, each defining an axis. Each of the outsole elements has a body and a cavity defined in the body. The cavity includes a continuous, ring-shaped internal undercut. Each of the outsole elements also includes a plurality of side walls. The outsole elements each include a rim that extends from the side walls toward the respective axis. Also, the outsole elements each include a second end. Furthermore, the outsole elements each include a first aperture defined in the respective rim. The first aperture receives a corresponding one of the lugs to removably couple the respective outsole element to the respective lug. As such, the rim is disposed in the undercut of the lug between the respective flange and the base. Also, the flange is received in the internal undercut, and the second end at least partially covers the terminal end of the lug.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings. Corresponding parts of different embodiments are indicated by corresponding reference numerals of multiples of 100.

DETAILED DESCRIPTION

Example embodiments will now be described more fully with reference to the accompanying drawings.

Figure 1:
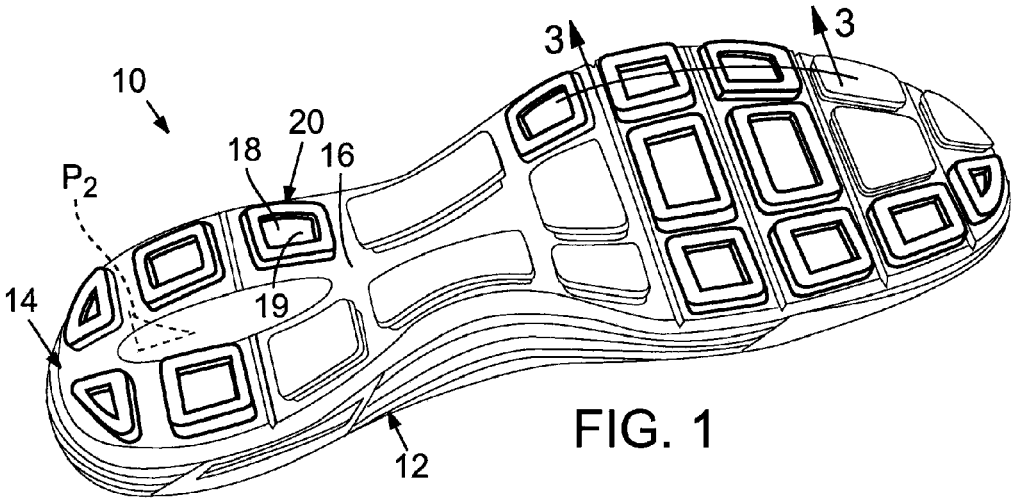
FIG. 1 is a perspective view of an article of footwear with various exemplary embodiments of outsole elements according to the present disclosure.

Referring initially to FIG. 1, an exemplary embodiment of an article of footwear 10 is illustrated. The footwear 10 generally includes an upper 12, a midsole 14, and a plurality of outsole elements 20.

Figure 2A:
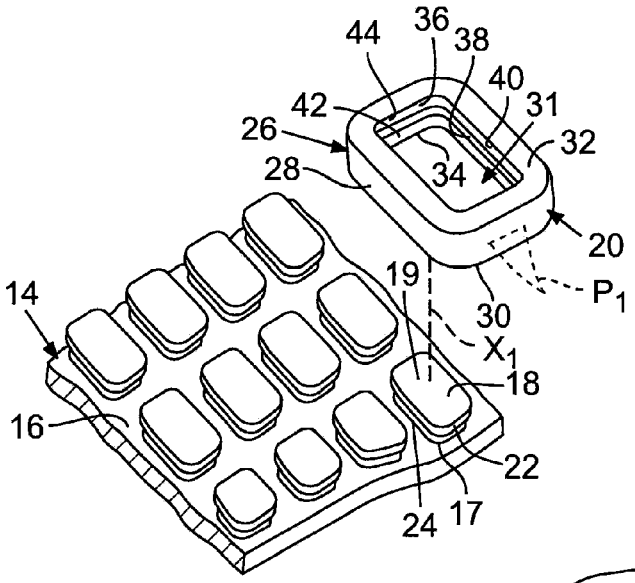
FIG. 2A is a perspective exploded view of a portion of an article of footwear and an exemplary embodiment of the outsole element according to the present disclosure.
Figure 3:
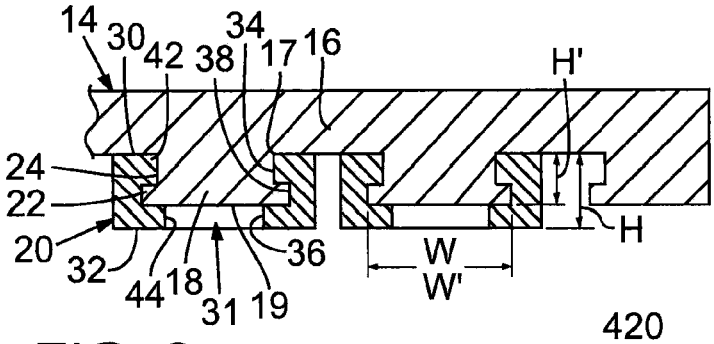
FIG. 3 is a sectional view of the article of footwear taken along the line 3-3 of FIG. 1.

As shown in FIGS. 1, 2A, and 3, the midsole 14 generally includes a base 16 and a plurality of lugs 18. The lugs 18 can be integrally coupled to the base 16 at a base end 17. The lugs 18 extend away from the base 16, and each defines a terminal end 19 that is opposite the base end 17. In some embodiments, the lugs 18 each include a flange 22 adjacent the terminal end 19 and an undercut 24 (i.e., an external undercut) between the flange 22 and the base 16. The undercut 24 can be continuous and ring-shaped so as to extend continuously about the entirety of the lug 18. It will be appreciated that the lugs 18 could be of any size or shape, such as a rectangular, square, triangular, or other shape. Also, in some embodiments, the base 16 and the lugs 18 are made of a resiliently flexible material, such as foam cushioning material. Furthermore, the base 16 and lugs 18 can be manufactured using any suitable method. In some embodiments, for instance, the base 16 and the lugs 18 are monolithic and are made using an injection phylon, a laser sintering, or other manufacturing method.

The outsole elements 20 are removably coupled to corresponding lugs 18, as will be discussed in greater detail below. The outsole elements 20 generally provide traction for the footwear 10. Also, because they are removable coupled to the lugs 18, the outsole elements 20 provide a greater degree of variability for the footwear 10.

The outsole elements 20 can be of any suitable shape. Also, the shape of the outsole elements 20 can vary, depending on the position on the footwear 10. For instance, in some embodiments represented in FIGS. 2A and 3, the outsole element 20 is generally rectangular, continuous, and ring-shaped. As such, the outsole element 20 defines a body 26 with a sidewall 28 that extends continuously around the periphery of the outsole element 20. The body 26 defines a first end 30 and a second end 32 that are opposite each other. A cavity 31 is also defined within the body 26. Furthermore, a first aperture 34 is defined in the first end 30, and a second aperture 36 is defined in the second end 32. The first aperture 34 and the second aperture 36 each provide access into the cavity 31. Moreover, as shown in FIG. 2A, the body 26 defines an axis X that extends generally perpendicular to the first and second ends 30, 32. The apertures 34, 36 are substantially centered on the respective ends 30, 32 such that the axis X extends through each aperture 34, 36. Additionally, the cavity 31 includes (is partially defined by) an internal undercut 38 on an inner surface 40 of the body 26. The internal undercut 38 is ring-shaped and extends continuously about the entire inner surface 40 so as to circumvent the body 26, and the internal undercut 38 extends in from the inner surface 40 in a direction traverse to the axis X. As such, the outsole element 20 further defines a first rim 42 and second rim 44 (FIG. 3). The first rim 42 is adjacent the first end 30, and the second rim 44 is adjacent the second end 32. Each rim 42, 44 extends generally traverse toward the axis X, and the internal undercut 38 is defined between the first and second rims 42, 44.

The outsole element 20 can be made out of any suitable material. For instance, in some embodiments, the outsole element 20 is made out of rubber, thermoplastic rubber (TPR), or thermoplastic urethane (TPU). Accordingly, the outsole element 20 can be resiliently flexible and can provide a high degree of traction and resistance to wear.

Also, the outsole element 20 can be manufactured in any suitable fashion. In some embodiments, the outsole element 20 can be manufactured using one of a variety of so-called rapid prototyping methods. For instance, a bulk supply of polymeric powder can be supplied, and a laser can be directed toward the power. The laser can move across the powder in the shape of the outsole element 20, and the energy from the laser can fuse small amounts of the powder particles together, wherever the laser is directed. The bulk supply of powder can be occasionally advanced such that the outsole element 20 can be eventually formed "layer-by-layer" in this method.

With reference to FIGS. 2A and 3, an exemplary embodiment of the attachment between the outsole element 20 and the lug 18 will be discussed. In the embodiments illustrated, the cavity 31 of the outsole element 20 receives the lug 18 to removably couple the body 26 of the outsole element 20 to the lug 18. Specifically, the flange 22 of the lug 18 moves through the first aperture 34 of the outsole element 20 when the outsole element 20 is attached to the lug 18. Furthermore, the first rim 42 is received and disposed in the undercut 24 of the lug 18, and the flange 22 of the lug 18 is received and disposed in the undercut 38 of the outsole element 20. Thus, the attachment of the outsole element 20 to the lug 18 can be substantially strong, and yet the outsole element 20 can be removed from the lug 18 when desired.

As shown in FIG. 3, the height H of the outsole element 20 is greater than the height H' of the lug 18 such that the outsole element 20 extends away from the base 16 and past the terminal end 19 of the lug 18. Furthermore, the second rim 44 partially covers the terminal end 19 of the lug 18, as shown in FIG. 3. Accordingly, the outsole element 20 provides traction for the footwear 10 and protects the lug 18 and base 16 from wear.

Figure 10:
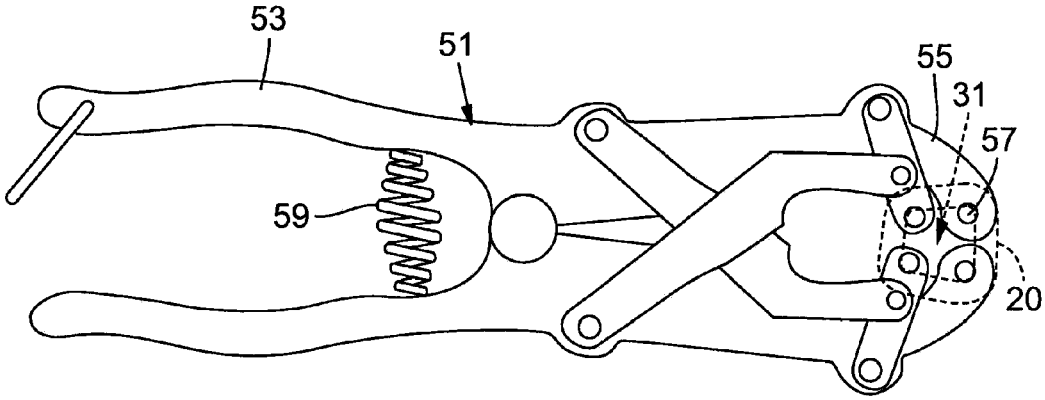
FIG. 10 is a side view of an exemplary tool for selectively and resiliently flexing and expanding an outsole element, wherein the tool holds the outsole element at a reduced width.
Figure 11:
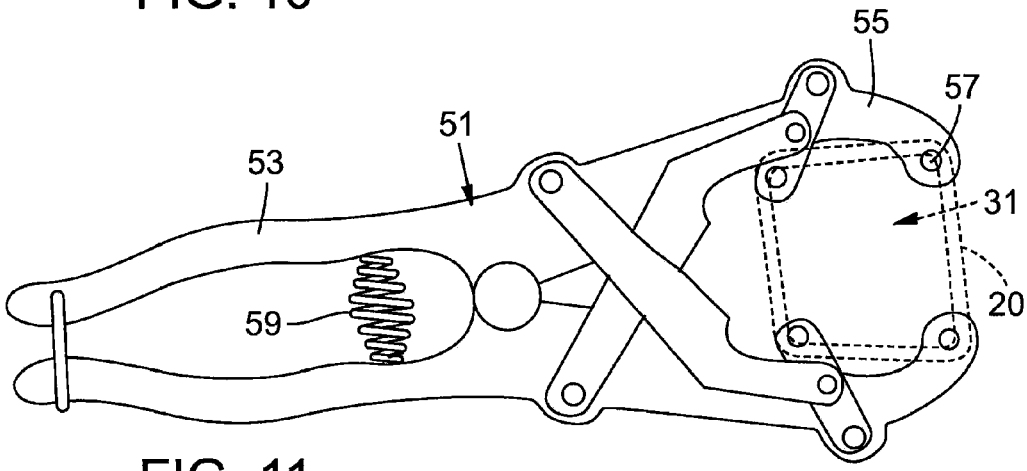
FIG. 11 is a side view of the tool of FIG. 10, wherein the outsole element is held by the tool at an increased width.

The outsole element 20 can be coupled to the lug 18 in any suitable fashion. For instance, as shown in FIGS. 10 and 11, a tool 51 (e.g., a scissors-like tool) are used to selectively change the width of the cavity 31 of the outsole element 20. Specifically, the tool 51 can include a scissors-like handle 53 and a head 55 with a plurality of contact elements 57. The tool 51 can also include a biasing member 59, such as a helical compression spring. The outsole element 20 can extend over each of the contact elements 52, and as shown in FIG. 10, the biasing member 59 can bias the contact elements 57 toward each other such that the width of the cavity 31 remains relatively small. However, as shown in FIG. 11, when the user squeezes the handle 53 against the biasing force of the biasing member 59, the contact elements 57 can be forced apart, thereby resiliently stretching and increasing the width of the cavity 31 of the outsole element 20. Accordingly, the cavity 31 can be selectively made wide enough to receive the lug 18 and to position the flange 22 of the lug 18 into the undercut 38 of the outsole element 20. The tool 51 can be similarly used to remove the outsole element 20 from the lug 18.

Also, in some embodiments, the tool 51 can be part of an automated system. For instance, the head 51 and contact elements 57 can be operably coupled to a machine (e.g., a robot) that automatically moves the head 51 and contact elements 57. As such, the contact elements 75 can automatically pick up and grab the outsole element 20 and can further expand the outsole elements 20 to attach the outsole element 20 to the lug 18. In some additional embodiments, a worker can place the outsole element 20 on the contact elements 57, and the contact elements 57 can then automatically expand the outsole element 20 for attachment to the lug 18. It will be appreciated, then, that the tool 51 can be partially automated or fully automated for use.

In some embodiments, the tool 51 and a plurality of different outsole elements 20 (differing in visual appearance, wear resistance, frictional behavior, etc.) can be included or sold in a system or kit. The midsole 14 can be included or sold together with the tool 51 and outsole elements 20 as well. As such, the user can interchange and replace the outsole elements 20 conveniently. In other embodiments, the midsole 14, the tool 51, and the outsole elements 20 can be sold separately.

Specifically, in the embodiment represented in FIG. 3, the undercut 38 of the outsole element 20 has a width W that is less than the width W' of the flange 22 of the lug 18. The body 26 is resiliently expanded to allow the first aperture 34 to receive the flange 22. Once the first rim 42 advances over the flange 22, the body 26 flexes back towards its original (neutral) shape to attach to the lug 18. Thus, when the outsole element 20 is coupled to the lug 18, the outsole element 20 is held to the lug 18 by friction and interference between the flange 22 and the rims 42, 44.

In other embodiments, a tool (not shown) is used to compress the lug 18, and the outsole element 20 is advanced over the lug 18 in this compressed state. Then, the lug 18 is released, and the lug 18 recovers substantially to its original shape such that the flange 22 is received in the undercut 38 of the outsole element 20.

In addition, the outsole element 20 is substantially symmetrical with respect to a plane $P_1$ (FIG. 2A) that is perpendicular to the axis $X_1$ and that is located approximately halfway between the first and second ends 30, 32. (This symmetry does not appear in FIG. 3 due to deformation of the outsole element 20 when coupled to the lug 18.) As such, either the first or second apertures 34, 36 can receive the lug 18, and the outsole element 20 can be flipped, for instance, if one of the ends 30, 32 becomes worn. Accordingly, the useful life of the outsole element 20 can be extended.

Furthermore, in some embodiments, the footwear 10 defines a second plane $P_2$ (FIG. 1) that is substantially perpendicular to the base 16 and that extends along the longitudinal axis of the base 16. At least some of the lugs 18 are disposed substantially symmetrically on the base 16 on opposite sides of the second plane $P_2$. Accordingly, the footwear 10 can include relatively few shapes for the outsole elements 20, and the same outsole element 20 can be used for lugs 18 on either side of the second plane $P_2$, simply by flipping the outsole element 20 with respect to the first plane $P_1$. Accordingly, the footwear 10 can be manufactured at a reduced cost because, for instance, fewer molds or other unique manufacturing steps would be needed to produce the outsole elements 20.

Figure 2B:
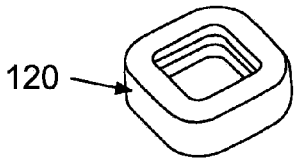
FIGS. 2B-2D are other exemplary embodiments of the outsole element according to the present disclosure.
Figure 2C:
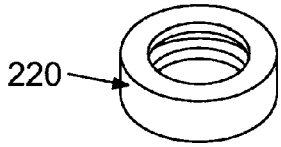
Figure 2D:
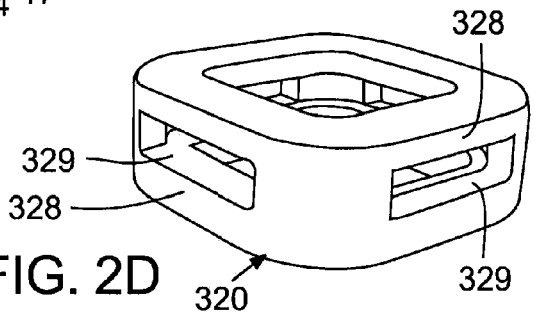

As shown in FIGS. 2B, 2C, and 2D, the outsole element 20 can have a variety of other shapes. For instance, in the embodiment of FIG. 2B, the outsole element 120 can be substantially square in shape. Also, in the embodiment of FIG. 2C, the outsole element 220 is substantially circular. Furthermore, in the embodiment of FIG. 2D, the outsole element 320 includes side walls 328 with corresponding side apertures 329 defined therein. The side apertures 329 can provide a different degree of flexion and/or resiliency of the outsole element 320 when the weight of the wearer is applied to the outsole element 320.

Figure 4A:
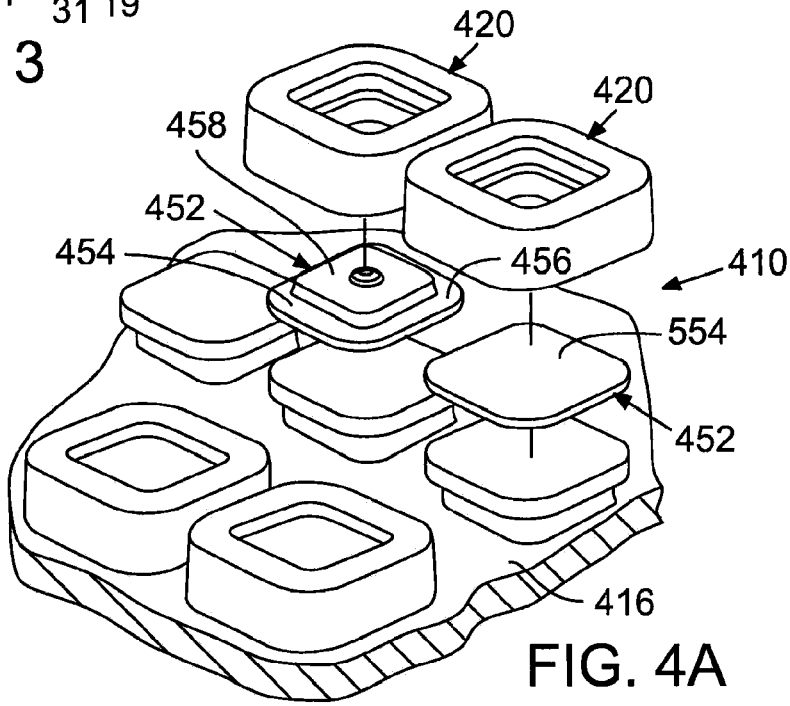
FIG. 4A is an exploded perspective view of an article of footwear according to various alternative embodiments of the present disclosure.
Figure 4B:
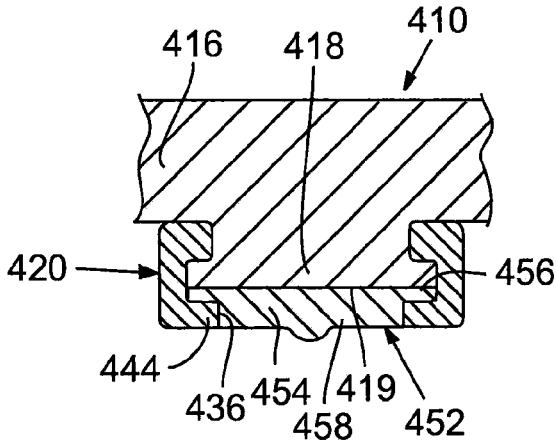
FIGS. 4B and 4C are a sectional views of the article of footwear of FIG. 4A.
Figure 4C:
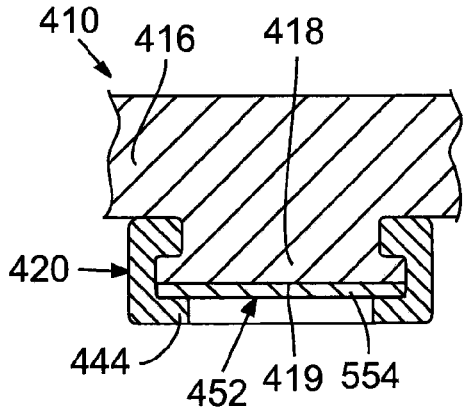

Referring now to FIGS. 4A, 4B, and 4C, another embodiment of the footwear 410 is illustrated. In the embodiment shown, the footwear 410 includes a secured element, generally indicated at 452.

As shown in FIGS. 4A and 4B, the secured element 452 is an insert 454 having a flange 456 and a projection 458. The flange 456 is disposed between the terminal end 419 of the lug 418 and the second rim 444 of the outsole element 420 (FIG. 4B). Also, the projection 458 extends into and is disposed within the second aperture 436 of the outsole element 420. Accordingly, the insert 454 can cover and protect the terminal end 419 of the lug 418 and can provide additional traction for the footwear 410. Also, the insert 454 can have a different color than the base 416 and outsole elements 420 for varying the aesthetics of the footwear 410. Furthermore, the insert 454 can be removeably attached to the footwear 410, thereby giving the wearer the ability to change the footwear 410 according to his/her desires.

In the embodiments represented in FIGS. 4A and 4C, the secured element 452 is a substantially flat insert 554. The flat insert 554 is substantially thin and flat. The flat insert 554 can cover the terminal end of 419 of the lug 418 and can be disposed between the terminal end 419 and the second rim 444 of the outsole element 420. The flat insert 554 can protect the lug 418 and can have any variety of colors, logos, or other features for varying the aesthetics of the footwear 410.

Figure 6:
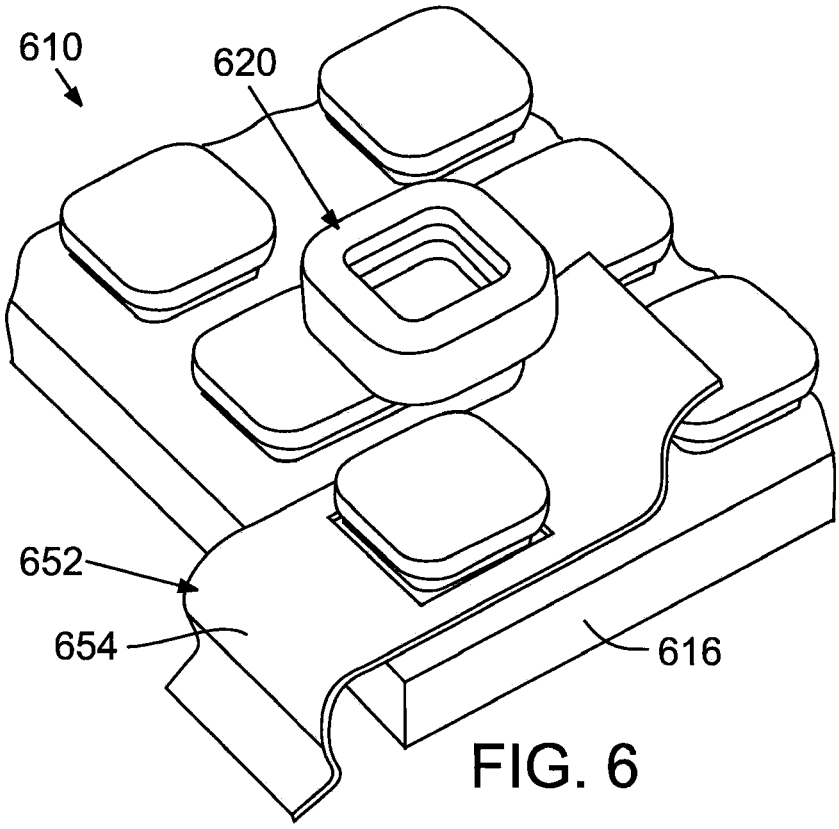
FIG. 6 is an exploded sectional view of an article of footwear according to various alternative embodiments of the present disclosure.

Additionally, in some embodiments represented in FIG. 6, the footwear 610 includes a strap 654 as the secured element 652. The strap 654 is disposed between the base 616 and the outsole element 620, and extends longitudinally from the base 616. It will be appreciated that the strap 654 can attach to any other portion of the footwear 610 for varying the aesthetics of the footwear 610, for providing a point of attachment to the upper, etc. Also, the outsole element 620 substantially protects the strap 654 from wear.

Figure 5:
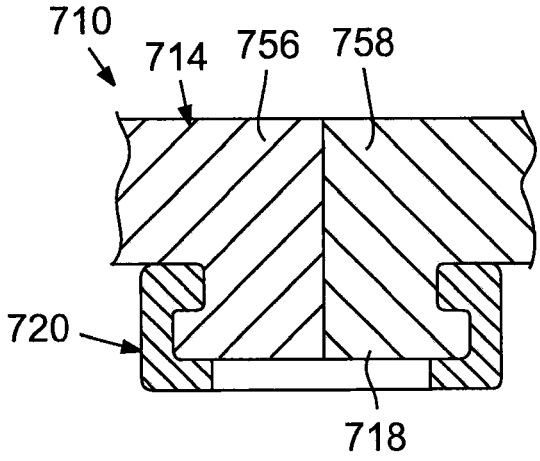
FIG. 5 is a sectional view of an article of footwear according to various alternative embodiments of the present disclosure.

In addition, in the embodiments represented in FIG. 5, the midsole 714 of the footwear 710 includes a first portion 756 and a second portion 758. The first and second portions 756, 758 cooperate to define a lug 718 of the type described above. Thus, the outsole element 720 receives each of the first and second portions 756, 758 and attaches to lug 718 in a manner substantially similar to the embodiments described above.

Figure 7:
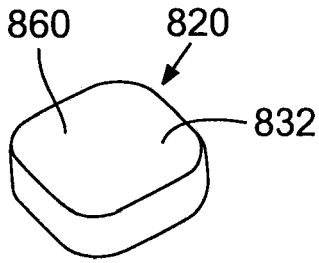
FIG. 7 is a perspective view of an outsole element according to various other embodiments of the present disclosure.
Figure 8:
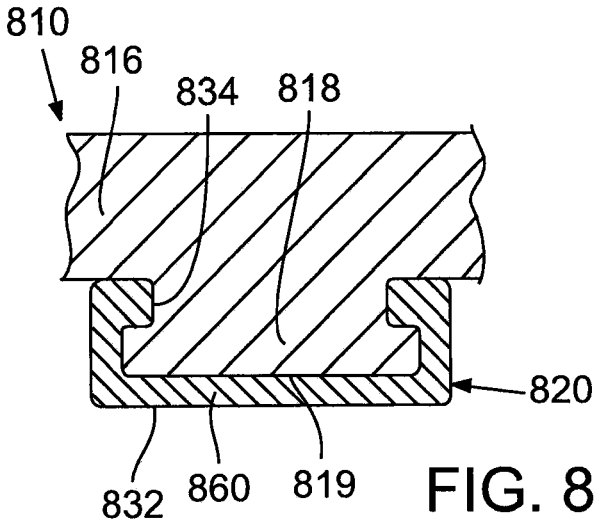
FIG. 8 is a sectional view of the outsole element of FIG. 7 coupled to a midsole of an article of footwear.

Additionally, in some embodiments represented in FIGS. 7 and 8, the outsole element 820 includes a cap 860 on the second end 832 thereof. When attached to the lug 818, the first aperture 834 receives the lug 818 (FIG. 8), and the cap 860 substantially covers the entire terminal end 819 of the lug 818. Accordingly, the cap 860 substantially protects the lug 818 from wear.

Figure 9:
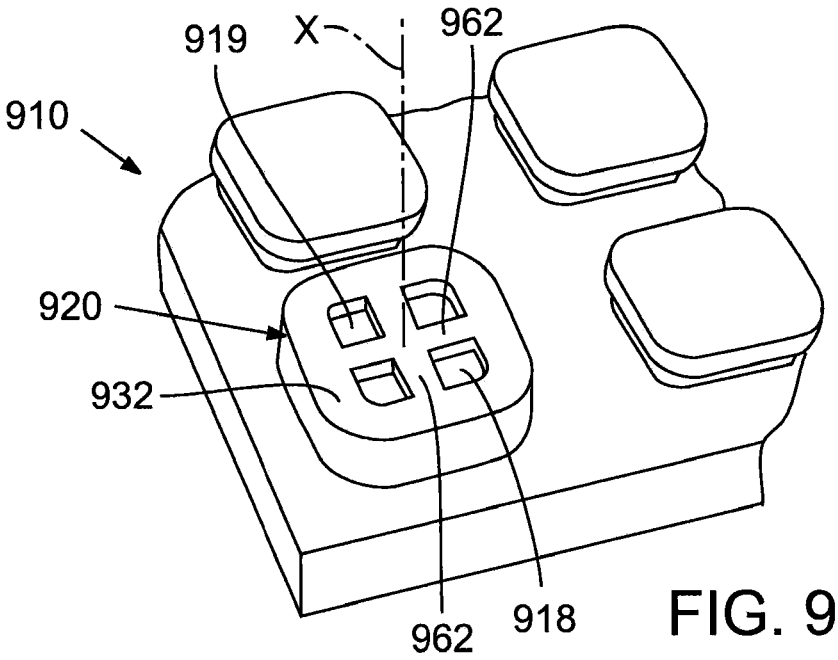
FIG. 9 is a perspective view of an article of footwear with an outsole element according to various alternative embodiments of the present disclosure.

Moreover, in some embodiments represented in FIG. 9, the outsole element 920 includes one or more transverse members 962 that are disposed on the second end 932 thereof. The transverse members 962 extend generally transverse to the axis X and intersect each other to partially cover the terminal end 919 of the lug 918.

Accordingly, it will be appreciated that the removable outsole elements 20-920 provide traction to the footwear 10-910. Also, because the outsole elements 20-920 are removably coupled, the wearer can vary the amount of traction for the corresponding footwear 10-910. Also, in some embodiments, the wearer can mix and match various outsole elements 20-920 on one article of footwear 10-910. For instance, higher friction outsole elements 20-920 can be attached on one portion of the footwear 10, and lower friction elements 20-920 can be attached on another portion. Also, the outsole elements 20-920 on the footwear 10 can have different wear resistance characteristics. Moreover, the outsole elements 20-920 on the single article of footwear 10 can vary in visual appearance (shape, color, etc.). Furthermore, because the outsole elements 20-920 are removably attached, the footwear 10-910 can have less environmental impact, for instance, because less solvents are used during manufacture, and because the outsole elements 20-920 can be recycled more easily in comparison with conventional footwear. In addition, the wearer can change the aesthetics of the footwear 10-910 very easily because of the removable outsole elements 20-920.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An outsole element for an article of footwear having a base and a lug that extends from the base, the outsole element comprising:

a body that includes a first end and a second end; and a cavity defined in the body, the cavity including an internal undercut that is configured to receive a portion of the lug to removably attach the body to the lug, wherein the body is configured to have a first orientation and a second orientation relative to the lug, the body being exposed to a ground surface in both the first orientation and the second orientation, the internal undercut receiving the portion of the lug in both the first orientation and the second orientation, the first end facing the base and the second end facing away from the base in the first orientation, the second end facing the base and the first end facing away from the base in the second orientation.

2. The outsole element of claim 1, wherein the first end includes a first aperture providing access into the cavity, and wherein the second end includes a second aperture providing access into the cavity.

3. The outsole element of claim 1, wherein the first end includes a first aperture providing access into the cavity, wherein the second end that is opposite the first end, wherein the first aperture is configured to receive the lug in the first orientation, and wherein the second end of the body is configured to at least partially cover a terminal end of the lug in the first orientation.

4. The outsole element of claim 1, wherein the first end includes a first aperture and wherein the second end includes a second aperture, wherein the body defines an axis that extends through the first aperture and the second aperture, and wherein the body is substantially symmetric with respect to a plane that is substantially perpendicular to the axis.

5. The outsole element of claim 1, wherein the second end of the body includes a transverse member that extends generally transverse to an axis of the body, the transverse member configured to partially cover a terminal end of the lug.

6. The outsole element of claim 1, wherein the lug includes a flange, wherein the internal undercut is configured to receive the flange.

7. The outsole element of claim 6, wherein the first end includes a first rim, wherein the lug includes an undercut defined between the flange and the base, and wherein the first rim is configured to be received within the undercut of the lug in the first orientation.

8. The outsole element of claim 7, wherein the second end includes a second rim, and wherein the internal undercut is defined between the first and second rims, and wherein the second rim is configured to extend partially over a terminal end of the lug.

9. The outsole element of claim 1, wherein the body defines a sidewall and further comprising a side aperture defined in the sidewall.

10. The outsole element of claim 1, the body defining a width that is less than a width of the lug, the body being resiliently flexible to flex to at least the width of the lug to removably couple to the lug.

11. The outsole element of claim 1, wherein the body defines an axis, and wherein the body is substantially symmetric about the axis of the body.

12. An article of footwear comprising:

a midsole that is resiliently compressible to provide cushioning for the article of footwear, the midsole including a base and a lug that extends from the base; and an outsole element having a body and a cavity defined in the body, the body being exposed to a ground surface and configured to provide traction on the ground surface, the body including a first end with a first aperture providing access into the cavity, the body including a second end with a second aperture providing access into the cavity, the first aperture and the cavity configured to receive the lug to removably couple the body to the lug, the cavity including an internal undercut configured to receive a portion of the lug to secure the body to the lug.

13. The article of footwear of claim 12, the lug includes a base end that is connected to the base and a terminal end that is opposite the base end, wherein the first aperture receives the lug and the second end of the body at least partially covers the terminal end of the lug.

14. The article of footwear of claim 12, wherein the lug includes a flange that is received within the internal undercut.

15. The article of footwear of claim 14, wherein the first end includes a first rim, wherein the lug includes an undercut defined between the flange and the base, and wherein the first rim is received within the undercut of the lug.

16. The article of footwear of claim 12, wherein the midsole includes a first portion and a second portion, the first portion including a first abutment surface, the second portion including a second abutment surface, the first abutment surface and the second abutment surface in abutment, the first portion and the second portion cooperating to define the lug, the first and second portions encompassed by the outsole element.

17. The article of footwear of claim 12, further comprising a secured element that is disposed between the midsole and the outsole element.

18. The article of footwear of claim 17, wherein the secured element is an insert that is disposed between a terminal end of the lug and the outsole element.

19. The article of footwear of claim 18, wherein the insert includes a projection that is disposed in the second aperture.

20. The article of footwear of claim 12, wherein the lug is one of a plurality of lugs that extend from the base, the plurality of lugs being substantially symmetrically disposed on opposite sides of a plane.

21. A system for modifying an article of footwear having a midsole with a base and a lug that extends from the base, the system comprising:

a plurality of outsole elements, each having a body and a cavity defined in the body, the body including a first end with a first aperture providing access into the cavity, the body including a second end with a second aperture providing access into the cavity, the cavity and the first aperture configured to receive the lug to removably couple the body to the lug, the cavity including an internal undercut, at least one of the plurality of outsole elements being resiliently flexible to increase a width of the first aperture and the second aperture to receive the lug within the first aperture; and a tool for selectively resiliently flexing the at least the plurality of outsole elements to removably couple the at least one of the plurality of outsole elements to the lug.

22. The system of claim 21, wherein the at least one of the plurality of outsole elements includes a first rim and a second rim, wherein the first rim defines the first aperture, wherein the second rim defines the second aperture, and wherein the tool is configured to contact the first rim and the second rim and increase the width of the at least one of the plurality of outsole elements to removably couple the at least one of the plurality of outsole elements to the lug.

23. The system of claim 21, wherein the plurality of outsole elements varies in at least one of visual appearance, wear resistance, and traction.

24. An article of footwear comprising:

a resiliently compressible midsole that provides cushioning for the article of footwear, the midsole including a base and a lug extending from the base, the lug including a terminal end with a flange;

an outsole element defining an axis, the outsole element having a body and a cavity defined in the body, the cavity including an internal undercut, the outsole element including a first end with a first aperture, a second end with a second aperture, and a side wall extending between the first end and the second end, the first end defining a first surface, the second end defining a second surface that faces in a direction opposite the first surface, the first aperture receiving the lug and the internal undercut receiving the flange to removably couple the outsole element to the lug with the first surface facing the base, the second surface exposed to a ground surface to provide traction on the ground surface; and an insert that is removably attached to the outsole element and the lug, the insert being disposed between the second end of the outsole element and the terminal end of the lug, the insert at least partially covering the terminal end of the lug, the insert being exposed to the ground surface through the second aperture of the outsole element.

* * * * *